US008534353B2

(12) United States Patent
Groves

(10) Patent No.: US 8,534,353 B2
(45) Date of Patent: Sep. 17, 2013

(54) HYDRAULIC ACTUATED PUMP SYSTEM

(75) Inventor: Emil William Groves, Calgary (CA)

(73) Assignee: Canasonics Inc., Calgary, Alberta (CA)

( * ) Notice: Subject to any disclaimer, the term of this patent is extended or adjusted under 35 U.S.C. 154(b) by 0 days.

(21) Appl. No.: 13/287,265

(22) Filed: Nov. 2, 2011

(65) Prior Publication Data

US 2012/0043076 A1 Feb. 23, 2012

Related U.S. Application Data

(62) Division of application No. 12/246,255, filed on Oct. 6, 2008, now Pat. No. 8,069,914.

(60) Provisional application No. 60/978,007, filed on Oct. 5, 2007.

(51) Int. Cl.
*E21B 43/25* (2006.01)
*E21B 28/00* (2006.01)

(52) U.S. Cl.
USPC ..... 166/249; 166/177.1; 166/177.2

(58) Field of Classification Search
USPC ..... 166/177.1–177.2, 177.6, 177.7, 249
See application file for complete search history.

(56) References Cited

U.S. PATENT DOCUMENTS

| | | | | |
|---|---|---|---|---|
| 2,680,485 | A | 6/1954 | Bodine, Jr. | |
| 3,234,890 | A | 2/1966 | Adams et al. | |
| 3,415,330 | A | 12/1968 | Bouyoucos | |
| 3,520,362 | A * | 7/1970 | Galle | 166/249 |
| 3,730,269 | A | 5/1973 | Galle | |
| 3,754,598 | A * | 8/1973 | Holloway, Jr. | 166/249 |
| 4,083,660 | A | 4/1978 | Newbrough | |
| 8,069,914 | B2 | 12/2011 | Groves | |
| 2005/0230107 | A1 * | 10/2005 | McDaniel et al. | 166/249 |
| 2009/0008088 | A1 * | 1/2009 | Schultz et al. | 166/249 |

FOREIGN PATENT DOCUMENTS

| | | |
|---|---|---|
| CA | 2232948 | 9/1998 |
| CA | 2502800 | 9/2005 |
| CA | 2640465 | 4/2009 |
| WO | 2007100352 | 9/2007 |
| WO | 2008037069 | 4/2008 |

* cited by examiner

*Primary Examiner* — Giovanna Wright
(74) *Attorney, Agent, or Firm* — Bennett Jones LLP

(57) ABSTRACT

The invention is directed to a hydraulic actuated pump system which lifts production fluids and re-circulating hydraulic fluid from a petroleum well. Additives may be added to the hydraulic fluid to apply direct chemical treatment to the production formation. A sonic stimulator may be included to stimulate and produce the same liquids from the horizontal section of the well.

11 Claims, 11 Drawing Sheets a
a
b
48

14
30
46
70
70
50
14
30
54
14
30
44
42
18
52
38
38
70
38
38

HYDRAULIC ACTUATED PUMP SYSTEM

CROSSREFERENCE TO RELATED APPLICATIONS

This application is a divisional application of United States patent application Ser. No. 12/246,255 filed on Oct. 6, 2008, which application claimed the priority of U.S. Provisional Patent Application 60/978,007 filed Oct. 5, 2007, entitled "Hydraulic Actuated Pump System, the entire contents of which are incorporated by reference.

FIELD OF THE INVENTION

The present invention relates to a hydraulic actuated pump system and sonic stimulation tools for downhole applications.

BACKGROUND OF THE INVENTION

Within a petroleum producing well, the production string forms the primary conduit through which production fluids (liquids, gases, or any fluid produced from a wellbore) are produced to the surface. The production string is typically assembled with production tubing and completion components in a configuration that suits the wellbore conditions and the production method. Oil wells typically vary from a few hundred to several thousand feet in depth, and there is often insufficient formation pressure to cause the flow of production fluids through the production string to the surface.

Several prior art systems involving different pumping and extraction devices have been developed for the surface transfer of production fluids from a well. Downhole hydraulic pumps installed deep within the well are commonly used. A surface hydraulic pump pressurizes power oil which drives the downhole pump. When a single production string is used, the power oil is pumped down the tubing and a mixture of the formation crude oil and power oil are produced through the casing-tubing annulus. If two production strings are used, the power oil is pumped through one of the pipes, and the mixture of formation crude oil and power oil are produced in the other, parallel pipe.

Prior art artificial lift systems include for example, the progressive cavity pump and plunger lift, both of which are installed on jointed or continuous rods; electric submersible pumps; gear pumps installable on tubing and powered by downhole electric or hydraulic motors; and the venturi lift which is run on coiled tubing but is not a total production system. However, such systems tend to be complex and/or of substantial size and weight, requiring significant structural support elements at the wellhead which increase the expense of the overall system.

SUMMARY OF THE INVENTION

The present invention is directed to a hydraulic actuated pump system. In one aspect of the invention, the invention comprises a pump system for lifting production fluids to the surface or circulating service fluids in a wellbore, comprising:

(a) a cylindrical outer tubular member and an cylindrical inner tubular member in a concentric orientation therewith, defining an annular bore therebetween;

(b) a production packer sealing the annular bore in a downhole location proximate a production zone;

(c) means for pumping hydraulic fluid from the surface into the annular bore;

(d) wherein the inner tubular member defines an inner bore extending therethrough to allow upward passage of a mixture of hydraulic fluid and production fluids from the wellbore, wherein the inner bore is open to the production zone;

(e) a plurality of jet members spaced intermittently along the wellbore, wherein each jet member defines at least one jet nozzle providing fluid communication from the annular bore to the inner bore;

(f) wherein the at least one jet nozzle is adapted and oriented to provide a high velocity hydraulic fluid stream into the inner bore thereby providing a lift force to fluid in the inner bore.

In one embodiment, the jet members comprise a plurality of nozzles having diameters sized to project fluid streams. In one embodiment, the downhole assembly may include one or more of a production packer, a reciprocating bit, a sonic stimulator, a sonic stimulator with a reciprocating bit, a drill motor with a drill bit, or a drill motor with a casing reaming assembly. In one embodiment, the downhole assembly comprises a production packer having threaded hold-down slips, threaded set-down slips, and packer elements positioned between the hold-down slips and set-down slips to seal against an inner wall of the production casing.

In one embodiment, the downhole assembly comprises a sonic stimulator for emitting pressure waves into the formation production zone. In one embodiment, the sonic stimulator comprises an elongate body defining a bore extending therethrough, a plurality of tubular jet members, and a hydraulic coupling which generates pulsed pressure waves. In one embodiment, at least one of the jet members includes a nozzle.

In one embodiment, the sonic stimulator comprises an elongate body defining a bore extending therethrough to house a valve retainer, a valve, a plurality of jet members, a resonance assembly, a rod retainer, a piston assembly moveable between a first position and a second position, and biasing means for biasing the piston towards the first position. In one embodiment, the jet members comprise one or more nozzles. In one embodiment, the jet members are rotatable. In one embodiment, the biasing means comprises a coil spring.

In one embodiment, the hydraulic fluid comprises water, produced water, water-based fluids, water-oil emulsions, inorganic salt solutions, biodegradable plant-based hydraulic fluids, or synthetic or naturally occurring organic materials. In one embodiment, the hydraulic fluid is supplemented with one or more additives selected from oils, butanol, esters, silicones, alkylated aromatic hydrocarbons, polyalphaolefins, or corrosion inhibitors. In one embodiment, the one or more additives comprise a brine-based, heavy oil chemistry for creating a light oil-in-water emulsion within the production fluids. In one embodiment, the supplemented hydraulic fluid is sonified. In one embodiment, the hydraulic fluid or the supplemented hydraulic fluid is heated to a temperature ranging from about 30° to about 101° C.

In another aspect, the invention may comprise a sonic stimulator for downhole use in a petroleum well, comprising:

(a) an inlet for receiving a hydraulic fluid under pressure;

(b) a wave generator for generating an acoustic wave as the hydraulic fluid passes through the wave generator; and (c) a jet member for exhausting the hydraulic fluid from the sonic stimulator.

In another aspect, the invention may comprise a method of enhanced oil recovery from a formation, comprising the steps of:

(a) installing a sonic stimulator into a wellbore;

(b) activating the sonic stimulator with a hydraulic power fluid to produce acoustic waves and inject the hydraulic power fluid into the formation;

(c) using the hydraulic power fluid to sweep heavy oil towards a production well.

The hydraulic power fluid may comprise one or more additives to assist in mobilization or emulsification of the heavy oil. The addition of the additives may be tapered so as to place the additives in specific portions of the wellbore. The additives may comprise an alkaline component and a surfactant component.

In one embodiment, the wellbore is a production well, and comprises a vertical portion, and a horizontal portion, and the additives are added so as to place the additives in a toe portion of the horizontal portion. Alternatively, the wellbore may comprise an injection well, and is proximate one or more production wells.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF THE INVENTION

The present invention provides for a hydraulic actuated pump system. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

"Horizontal" means a plane that is substantially parallel to the plane of the horizon. "Vertical" means a plane that is perpendicular to the horizontal plane. One skilled in the art will recognize that wellbores may not be strictly vertical or horizontal, and may be slanted or curved in various configurations.

The hydraulic actuated pump system (1) lifts production fluids and re-circulating hydraulic fluid from the wellbore. The hydraulic fluid is pressurized to drive the system. Additives may be added to the hydraulic fluid to apply direct chemical treatment to the production formation. A sonic stimulator may be included in conjunction with the pump system to stimulate and produce the same liquids from the well.

In one embodiment, the system may be applied to a well having a substantially vertical portion, and a substantially horizontal portion. Horizontal directional drilling to create such a wellbore is well known in the art.

Figure 1:
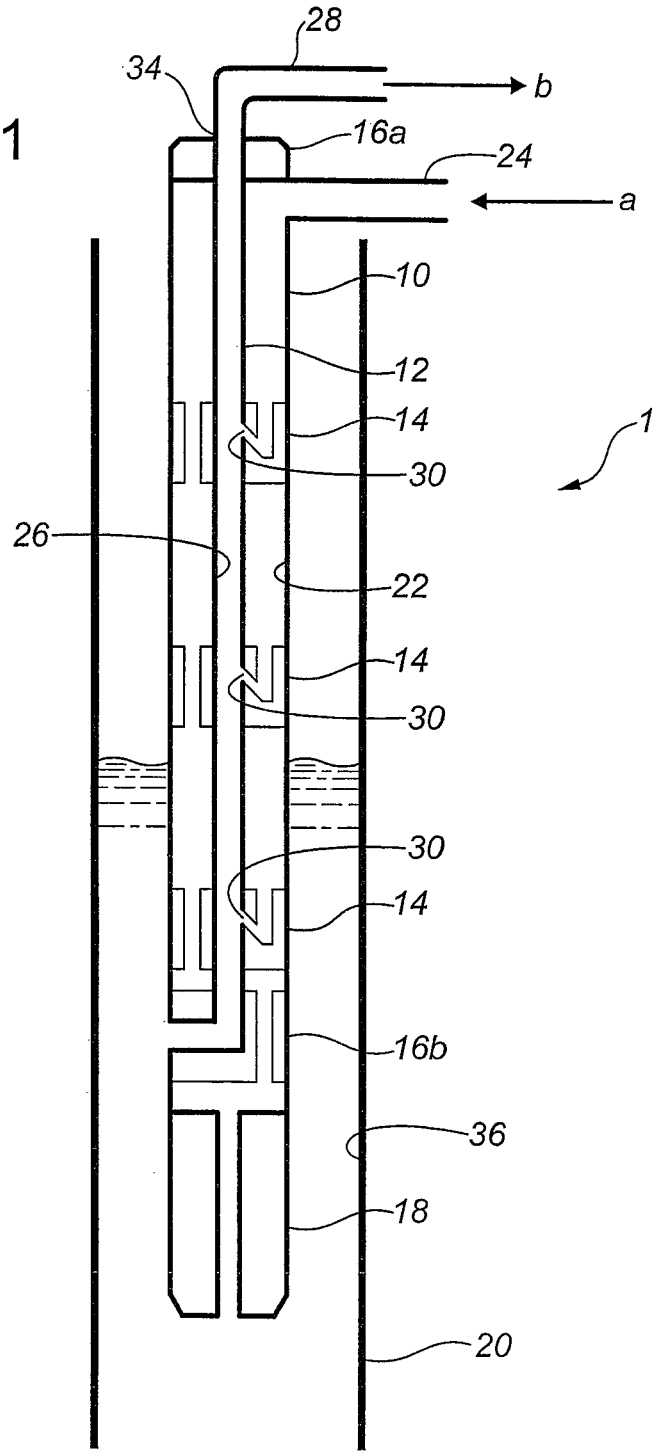
FIG. 1 is a schematic cross-sectional view of a pump system of one embodiment of the present invention.

The pump system (1) is shown schematically in FIG. 1 in a vertical well and comprises an outer tubular member (10), an inner tubular member (12), a plurality of jet members (14), a plurality of crossover members (16), and a downhole assembly (18). The well is cased with conventional well casing (20). As the annulus (36) between the pump system (1) and the production casing (20) is not necessarily used to transport fluids within the well, the pump system may be sized to fit within the casing to a close tolerance.

The outer tubular member (10) is generally cylindrical and houses the inner tubular member (12) in a concentric orientation therewith, forming an annular bore (22) to allow passage of hydraulic fluid (indicated by arrow "a") through an inlet (24) from the surface. As used herein and in the claims, the term "concentric" refers to components sharing a common center and thus a uniform annular dimension. However, two tubular members where one has a smaller diameter and is placed within the other may be considered concentric, even if they do not share the exact geometric centre, and even if they are not circular in cross-section.

The inner tubular member (12) is preferably generally cylindrical and defines an inner bore (26) which is open to the production zone of the formation. In one embodiment, the outer and inner tubular members (10, 12) are concentric coil or jointed tubular members. A coiled tubular member comprises a continuous length of tubing, while a jointed tubular member comprises lengths of tubing joined together by suitable attachment means. Both coiled and jointed tubing are well known in the art and further description is not needed.

A production packer (18) is provided as part of the downhole assembly to isolate the annular space between the inner and outer tubular members from the inner bore (26) of the inner tubular members.

Figure 1A:
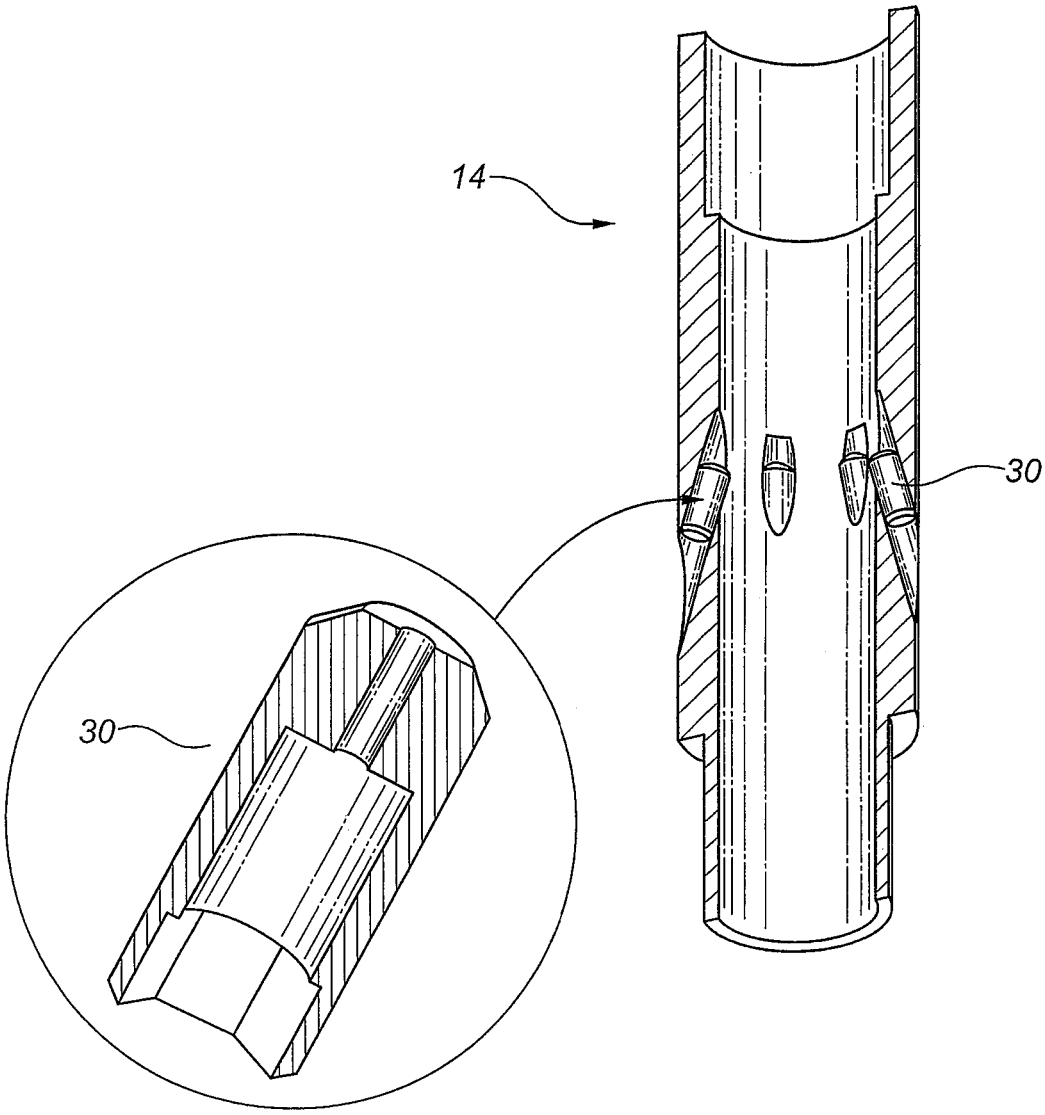
FIG. 1*a* is a diagrammatic representation of a tubular jet member of a pump system of FIG. 1.

A plurality of jet members (14) are provided along the length of the inner tubular members (12), spaced intermittently along the length of the wellbore. In one embodiment, the jet members (14) form part of the inner tubular string, and comprise at least one nozzle (30) having diameters sized to project streams of pressurized fluid (FIG. 1*a*). In a preferred embodiment, a plurality of nozzles are arrayed circumferentially about the diameter of the jet member (14) and are aimed upwards. In one embodiment, the nozzles (30) are convergent, narrowing from a wide diameter to a smaller diameter to accelerate fluid flow. In operation, power fluid is pumped into the annular space at high pressure. Because the annular space is closed by the production packer, the power fluid flows through the jet member nozzles (30) upwards into the inner bore. The jet members (14) create a high velocity flow upwards into the inner bore, creating a venturi effect and sucking production fluid upwards in the inner bore.

The jet members (14) may be centralized within the annulus by portions in contact with the outer tubular members, as shown schematically in FIG. 1. In this case, sufficient openings in the annular bore to allow power fluid to reach lower jet members must of course be provided. Alternatively, the jet members may form part of inner tubular string, and not contact the outer tubular members, as shown in FIG. 2.

Crossover members (16) are included to connect components with different thread types or sizes. In one embodiment, a crossover member (16*a*) is sized to connect and cap the outer and inner tubular members (10, 12) at the surface, and defines an aperture (34) through which the outlet means (28) extends to the surface. In one embodiment, a crossover member (16*b*) connects the outer and inner tubular members (10, 12) with the downhole assembly (18).

The downhole assembly may comprise one or more of a variety of components including, for example, a production packer (18), a reciprocating bit, a sonic stimulator, a sonic stimulator with a reciprocating bit, a drill motor with a drill bit, a drill motor with a casing reaming assembly, or other suitable components known to those skilled in the art. In one embodiment, the downhole assembly comprises a production packer (18) for anchoring the tubular members (10, 12) and isolating the annulus (36) from the production formation. The production packer (18) may comprise threaded hold-down slips (18*a*), threaded set-down slips (18*b*), and packer elements (18*c*) (for example, rubber O-rings) positioned between the hold-down slips (18*a*) and set-down slips (18*b*) to seal against the inner wall of the production casing (20) to isolate the well's annulus (36) from the production formation. Tail pipe or lower completion elements (18*d*) are mounted below the set-down slips (18*b*).

Figure 2:
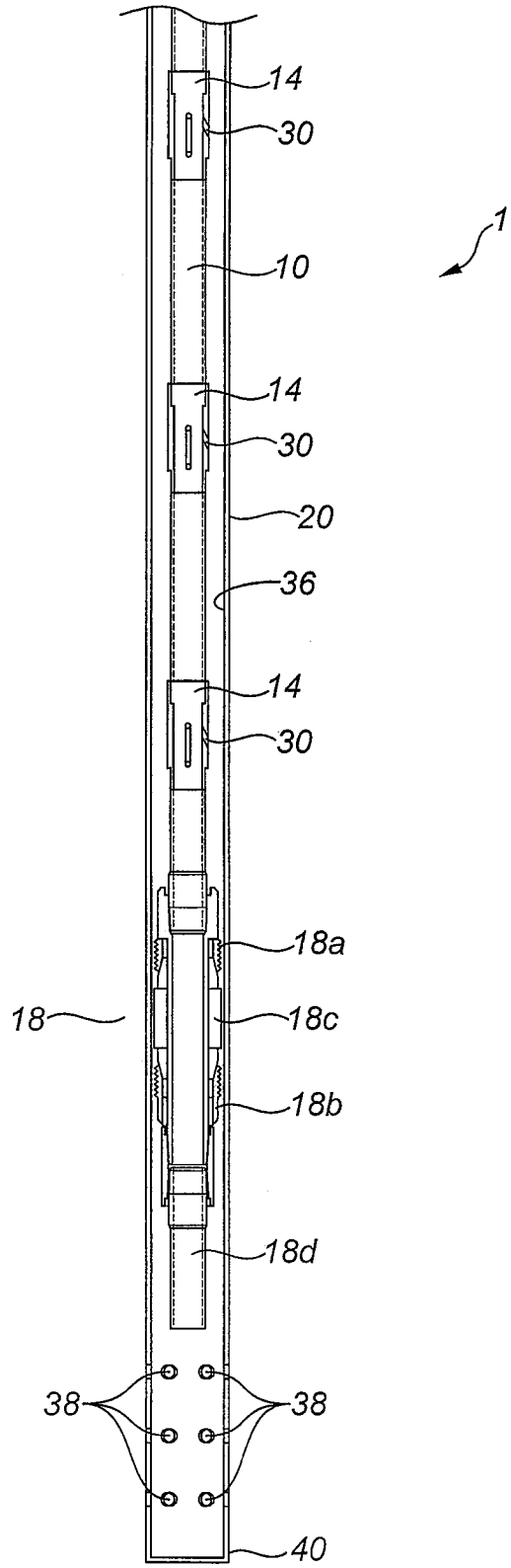
FIG. 2 is a diagrammatic representation of a pump system of one embodiment of the present invention.
Figure 3:
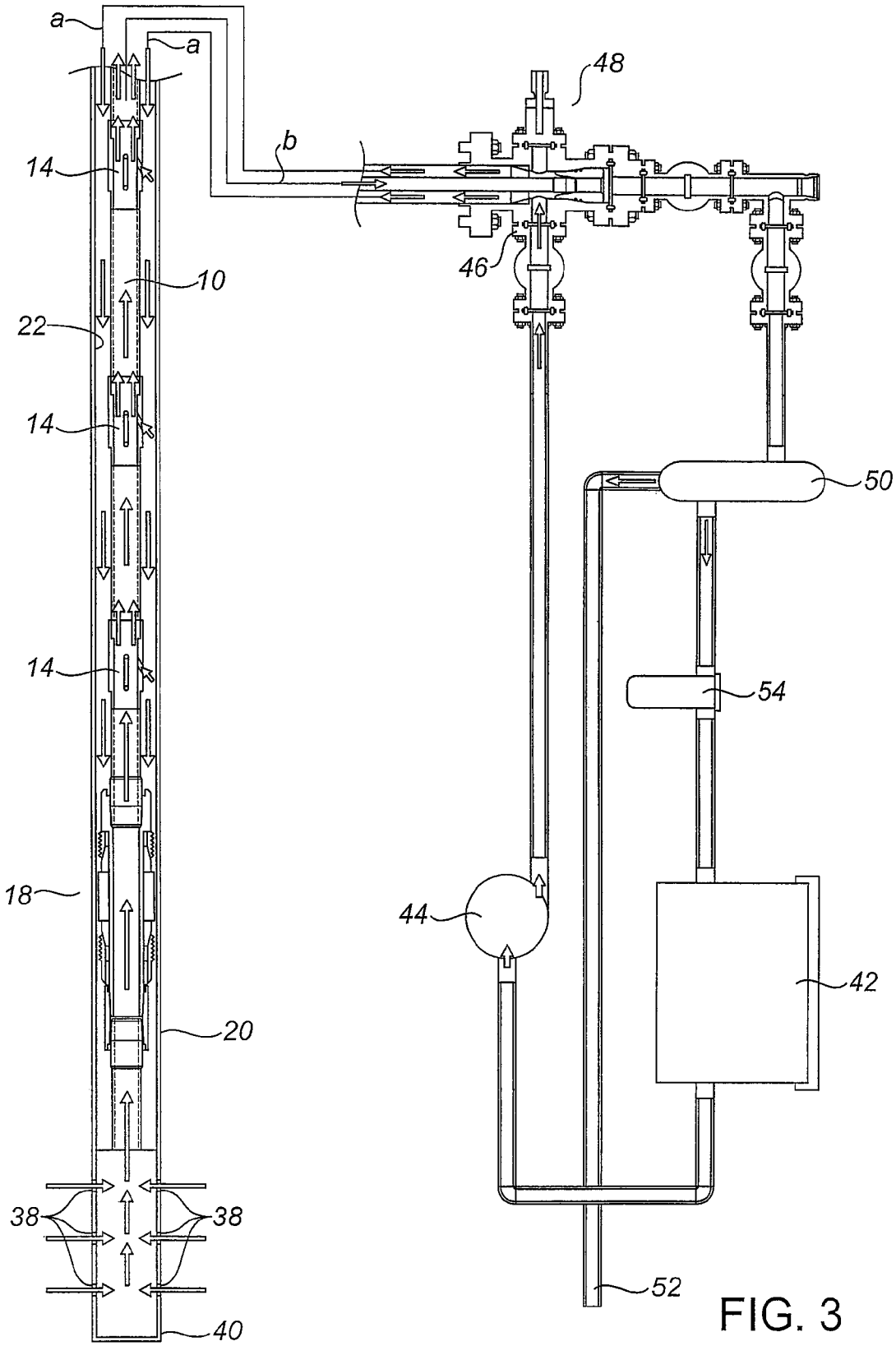
FIG. 3 is a diagrammatic representation of a pump system of FIG. 2 in connection with surface components.
Figure 4:
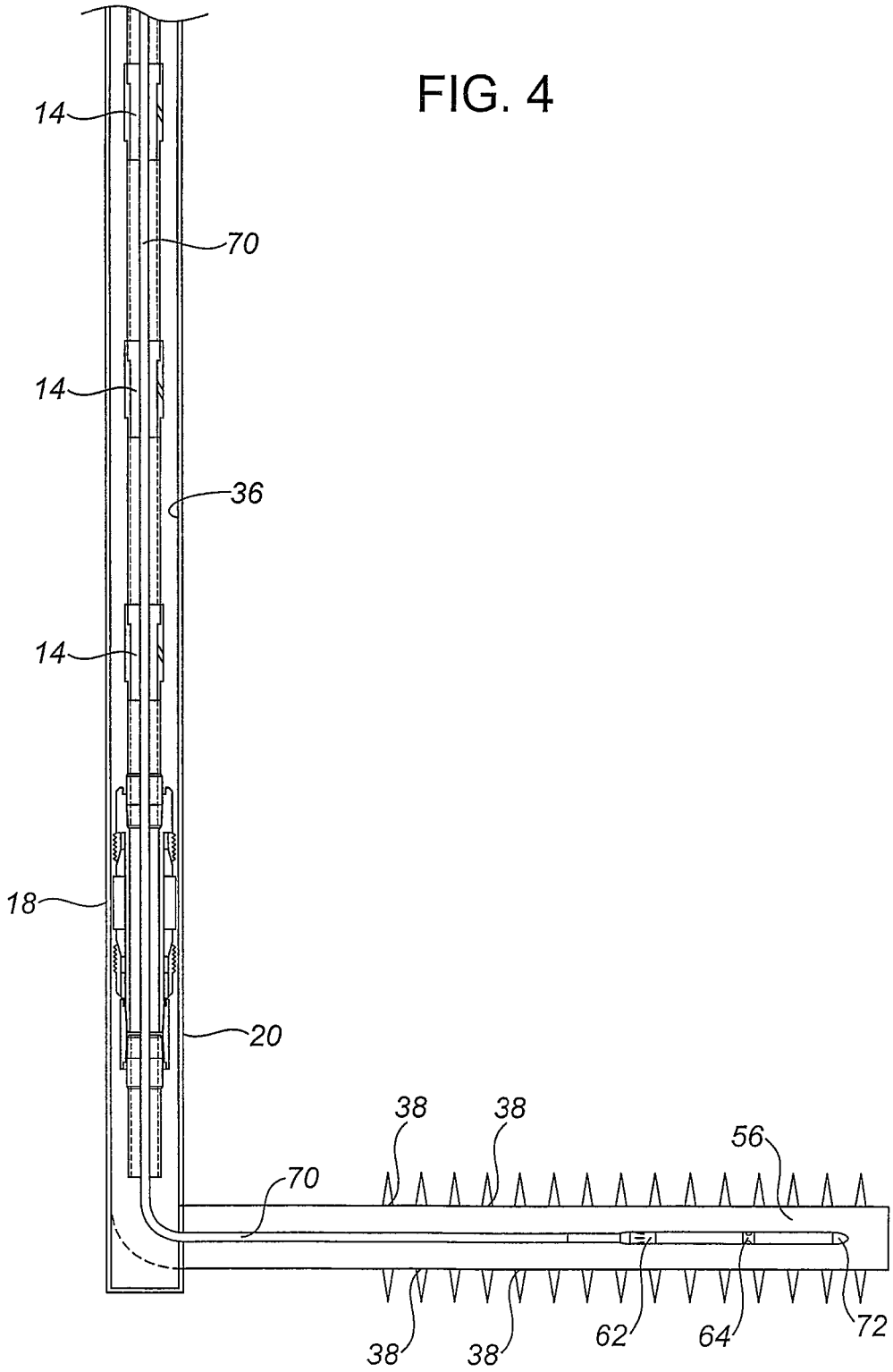
FIG. 4 is a diagrammatic representation of a pump system of one embodiment of the present invention, including a sonic stimulator.
Figure 5:
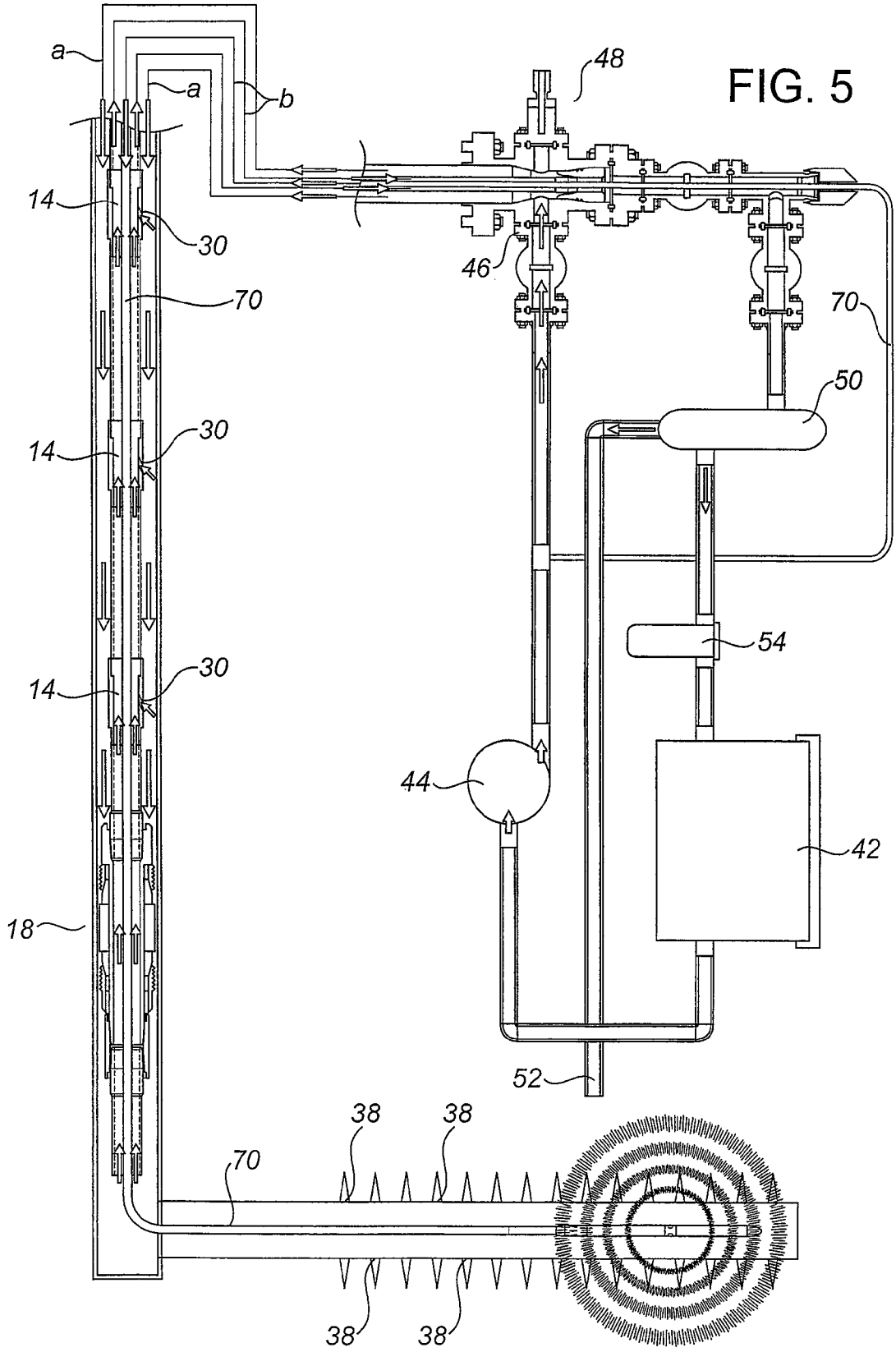
FIG. 5 is a diagrammatic representation of a pump system of FIG. 4 in connection with surface components.

In one embodiment shown in FIG. 2, the casing (20) has a plurality of perforations (38) at its end (40) to enable fluid communication with the formation production zone, namely the target reservoir rock containing production fluids including, for example, water, oil, condensates, or natural gas. FIG. 3 shows this embodiment of the invention in connection with surface components.

In operation, hydraulic power fluid (as indicated by arrows "a") is placed into a recirculation tank (42) at the surface. The operation of a recirculation tank (42) is commonly known to those skilled in the art and will not be discussed in detail. Briefly, the recirculation tank (42) for preparing power fluid is generally configured with a tank, a pump to circulate the fluid, and a manifold system to control recirculation and delivery of the fluid to the hydraulic pump (44).

Suitable hydraulic power fluid includes, for example, water, produced water, water-based fluids, water-oil emulsions, inorganic salt solutions, biodegradable plant-based hydraulic fluids, synthetic and naturally occurring organic materials to create a hydraulic oil or fluid of similar properties. Base stock may be any of, for example, castor oil, glycol, esters, mineral oil, organophosphate ester, polyalphaolefin, propylene glycol or silicone. Commercially available hydraulic fluids include, for example, Durad®, Fyrquel®, Houghton-Safe®, Hydraunycoil®, Lubritherm® Enviro-Safe, Pydraul®, Quintolubric®, Reofos®, Reolube®, and Skydrol®. The hydraulic fluid for the pump system is selected based upon various properties including, for example, stable viscosity, chemical and physical stability, system compatibility, flash point, low volatility, low coefficient of expansion, minimal rust formation and fire resistance. In one embodiment, the hydraulic fluid is water. In one embodiment, the hydraulic fluid is produced water which is re-circulated through the pump system (1).

Hydraulic fluid may be supplemented with one or more additives having desirable properties including, for example, the remediative capacity to carry solids, reduce oil viscosity, create and extend worm-holes in the wellbore area, solvate dead heavy oil, and establish communication with additional connate gas which assists fluid inflow. The additives may include oils, butanol, esters, silicones, alkylated aromatic hydrocarbons, polyalphaolefins, corrosion inhibitors, surfactants, dispersants, solvents, and other suitable chemical compounds. In one embodiment, the additive is a brine-based, heavy oil solution which creates a light oil-in-water emulsion within the production fluid. In one embodiment, the hydraulic fluid or supplemented hydraulic fluid may be heated to a temperature ranging from about 30° to about 101° C.

The hydraulic fluid, which may be heated, is then drawn through a hydraulic pump (44) and injected into the lower flow tee (46) of the wellhead (48) and into the outer tubular string (22). Injection of hydraulic fluid may be either batch or continuous injection. The hydraulic fluid injection rate relates to the volume of fluid injected in a well during hydraulic pumping. It will be understood by those skilled in the art that injection testing is initially conducted to establish the rate and pressure at which fluid can be pumped into the treatment target without damaging or fracturing the production formation. In one embodiment, the hydraulic pump (44) injects at rates ranging from about 60 to 400 L/min. at an operating pressure ranging from about 8 to 24 MPa. The heated hydraulic fluid is injected into the annulus (22) until the inner tubular members (12) and the formation have been fully saturated, thereby "priming" the pump system. Continued pumping lifts the mixture of hydraulic fluid and production fluids through the inner tubular member (12) via the venturi effect described above. The venturi effect increases the kinetic energy of the fluid, providing sufficient lift to reach the surface (as indicated by the arrow "b").

At the surface, a separator (50) separates the production fluids from the hydraulic fluid, directing the production fluid into one or more outflow lines (52) for further processing, and the hydraulic fluid through a filter (54) to the recirculation tank (42) for re-heating and re-entry into the pump system (1). The operation of a separator (50) is commonly known to those skilled in the art. Briefly, a separator (50) comprises a cylindrical or spherical vessel used to separate oil, gas and water from the total fluid stream produced by the well. Separators can be either horizontal or vertical. Separators can be classified into two-phase and three-phase separators, with the two-phase type dealing with oil and gas, and the three-phase type handling oil, water and gas. Gravity segregation is the main force that accomplishes the separation based on fluid density. Additionally, inside the vessel, the degree of separation between gas and liquid will depend on the separator operating pressure, the residence time of the fluid mixture and the type of flow of the fluid. Production separation begins with the well flowstreams entering the vessel horizontally and hitting a series of perpendicular plates. This causes liquids to drop to the bottom of the vessel while gas rises to the top. Gravity separates the liquids into oil and water. The gas, oil and water phases are metered individually as they exit the unit through separate outflow lines.

In one embodiment, the pump system (1) is installed within the well as a permanent production system. In one embodiment, the pump system (1) is portable, serving as a temporary work over, treating and clean out system, with outer and inner coils (not shown) substituting as the outer and inner tubular members (10, 12) respectively. In one embodiment, the outer coil has a diameter of 2 inches, while the inner coil has a diameter of 1.75 inches. The crossover member (16*b*) may be modified to receive a portion of the hydraulic fluid which is injected to power the pump system (1) within the inner coil, and divert the hydraulic fluid to run a combination of service tools off the end of the outer coil. The outer coil may be wound to a spool to be conveyed via a coiled tubing unit to a desired service interval. The coiled tubing unit has an integrated hydraulic pump, coil injector, and a production tank to handle the circulated solids and liquids, all preferably mounted on one vehicle. Tools which may be run off the end of the outer coil include, for example, a bit for scraping the casing of the wellbore by reciprocating the coil; a sonic stimulator; a drill motor with a drill bit; or other suitable tools known to those skilled in the art.

In one embodiment, the pump system (1) includes a sonic stimulator which emits acoustic waves to vibrate liquids and solids within the production formation. As used herein and in the claims, the term "acoustic waves" means pressure waves propagating through the production formation. In one embodiment, and without restriction to a theory, we believe the acoustic waves cause vibration at the molecular level of liquids and solids in the producing zone, which assists in the mobilization and production of fluids. Molecular vibration may result in one or more of the following beneficial effects: repairs and removes naturally occurring or man-made formation damage; suspends wellbore damage in suspension fluid; removes scale, filter cake, wax, asphaltenes, bitumen or other materials; increases reservoir connectivity, injectivity and production; enhances stimulation fluid; stimulates selectively; and decreases the viscosity of heavy oil to facilitate its mobilization.

The sonic stimulator can be incorporated with, for example, vertical, horizontal, liner, gas, oil, injection, and production wells. The sonic stimulator may be installed following completion of the well, and preferably after injection of the heated power liquid into the annulus (36). In one embodiment, the sonic stimulator is placed in the horizontal section of a well.

Once the pump system (1) has begun to lift the mixture of hydraulic fluid and production fluids to the surface, the sonic stimulator is injected using coiled tubing to the desired depth in the well's horizontal section. Use of a smaller diameter coiled tubing results in higher pressure, while a larger diameter coiled tubing results in lower pressure. Of course, pressure within the coiled tubing is dependent also on flowrate. The sonic stimulator may be injected into the wellhead (48) at the surface by a suitable crossover member or wellhead device (not shown). The coiled tubing is diverted to the discharge side of the hydraulic pump (44) which is adjusted to ensure that the injection rates are suitable for both the pump system (1) and the sonic stimulator.

The hydraulic fluid injected into the coiled tubing actuates the sonic stimulator's internal hydraulic drive, which creates acoustic waves. The hydraulic fluid exiting tubular jet members of the sonic stimulator permeates the formation, thereby creating a fluid environment which enables acoustic waves to propagate through the formation production zone. The penetration of the acoustic waves depends on numerous factors, including the amplitude and frequency of the waves, and the formation characteristics. In one embodiment, the acoustic waves may propagate up to about 12 feet outward within the formation. The acoustic waves mobilize fluids towards the horizontal section of the wellbore. Either or both the acoustic waves and the jet members of the sonic stimulator generate a negative pressure face at the perforations (38) of the horizontal section or the well to further mobilize the production fluids into the wellbore. The jet members then push the production fluids towards the vertical section of the well. The heated hydraulic fluid ensures that the production fluids, particularly the heavy oil, remain mobilized and less viscous as they are lifted to the surface by the pump system (1). At the surface, the separator (50) separates the production fluids from the hydraulic fluid, directing the production fluid into one or more outflow lines (52) for further processing, and the hydraulic fluid through a filter (54) to the recirculation tank (42) for re-heating and re-entry into the pump system (1).

An appropriate sonic stimulator for inclusion with the pump system (1) is selected based upon the quality and volume of hydraulic fluid required for the well. In one embodiment, the sonic stimulator (56) is included in the pump system (1) in which the quality of the hydraulic fluid is exceptional and the hydraulic fluid injection rate exceeds about 60 L/min. In one embodiment, the sonic stimulator (82) is included in the pump system (1) in which the quality of the hydraulic fluid is poor and the hydraulic fluid injection rate is less than about 60 L/min. The flow rate required to create lift in the inner bore is typically between about 30-300 L/min, at a pressure of about 7-14 MPa.

In general terms, the sonic stimulator (56) may be any device which produces acoustic waves from a stream of pressurized hydraulic fluid. Acoustic waves are pressure waves which propagate through the hydraulic fluid, and through the formation.

In one embodiment shown in FIGS. 4 to 7, the sonic stimulator (56) comprises an elongate body (58) defining a bore (60) extending therethrough, a plurality of tubular jet members (62), and a hydraulic coupling (64). A crossover (66) connects the jet members (62) within the elongate body (58). In one embodiment, additional jet members (68) are included to provide extra lift for heavy solid production. In one embodiment, jet members (62) are positioned at the end and the middle sections of the body (58).

Figure 6:
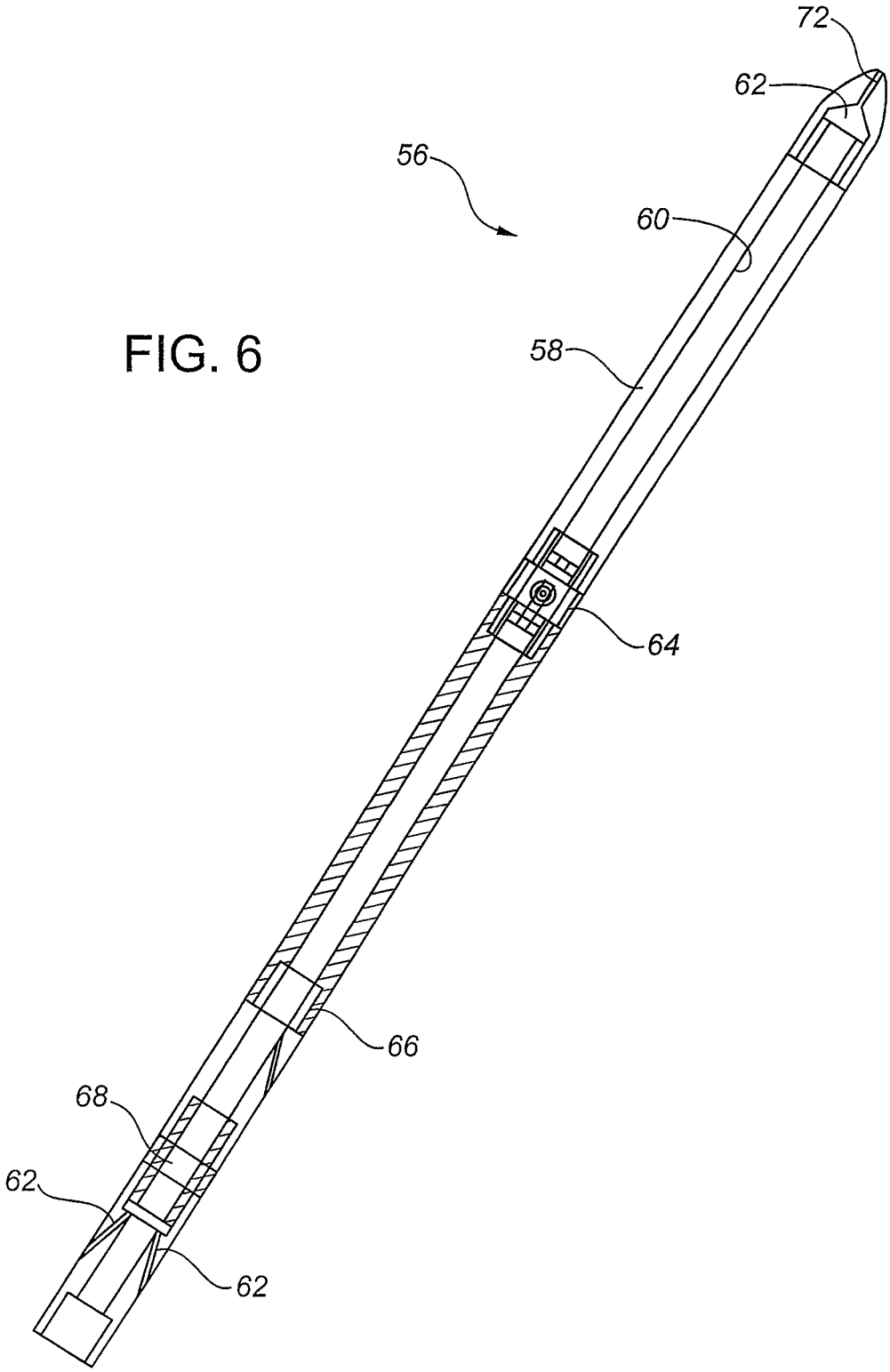
FIG. 6 is a diagrammatic representation of a sonic stimulator of one embodiment of the present invention.
Figure 7:
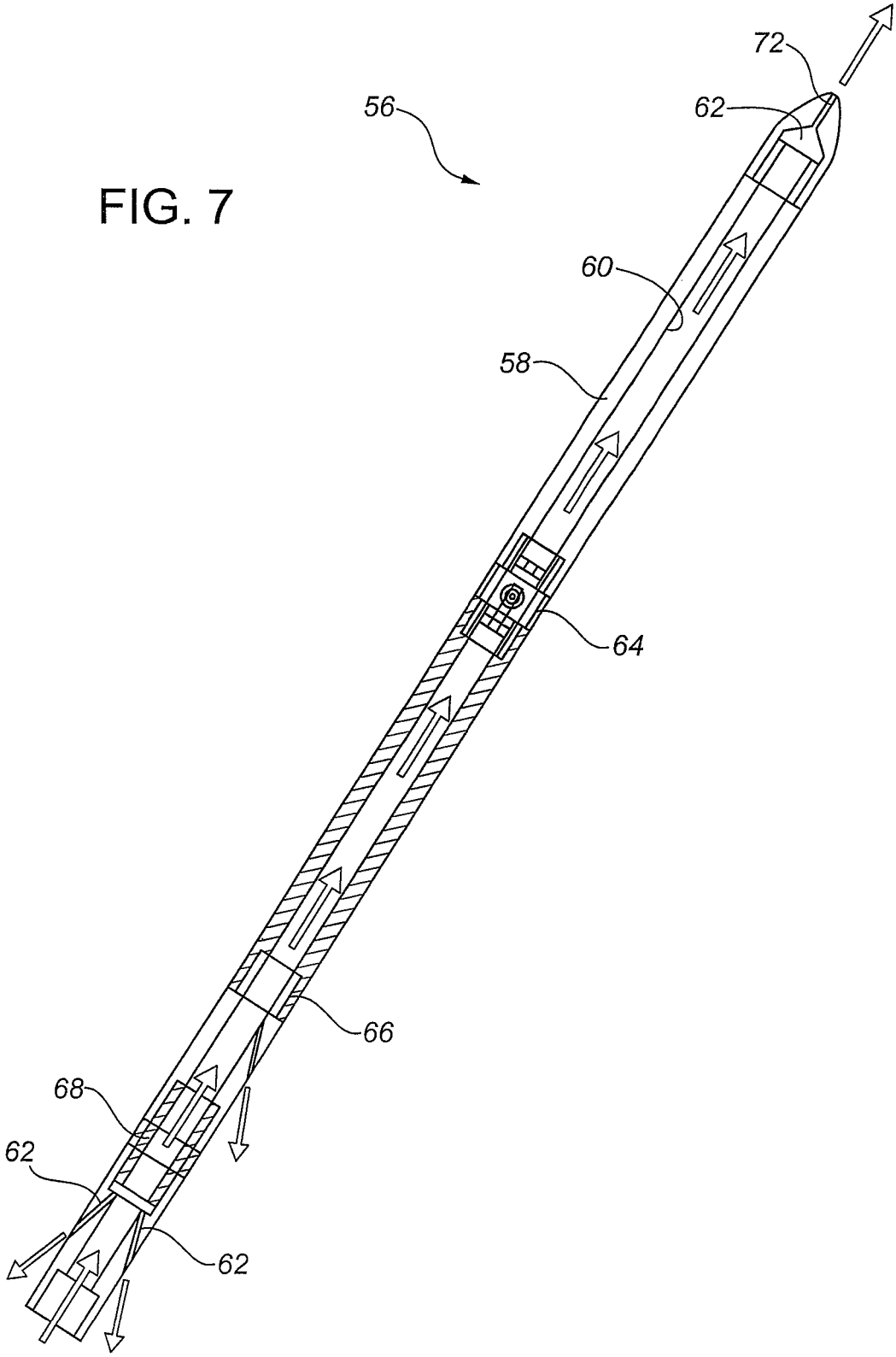
FIG. 7 is a diagrammatic representation of a sonic stimulator of FIG. 6, showing the pathway of hydraulic fluid.

As indicated in FIG. 7, the hydraulic fluid enters the sonic stimulator (56) via the coiled tubing (70) attached to the hydraulic pump (44) at the surface. The hydraulic fluid passes through the bore (60) of the sonic stimulator (56) and into the hydraulic coupling (64). The jet members (62) expel the hydraulic fluid from both ends of the sonic stimulator (56). In one embodiment, at least one of the jet members (62) includes a nozzle (72) which produces a high velocity stream of fluid. This fluid stream may act as a cleaner during installation of the sonic stimulator (56), and contributes to the negative pressure face at the perforations (38). In one embodiment, at least one jet member (62) is machined to project at an angle as shown in FIG. 6, such that the expelled hydraulic fluid creates a vortex which provides lift to produced solids. The hydraulic fluid exits the jet members (62) from the middle of the sonic stimulator (56) by operation of the hydraulic coupling (64).

Figure 8:
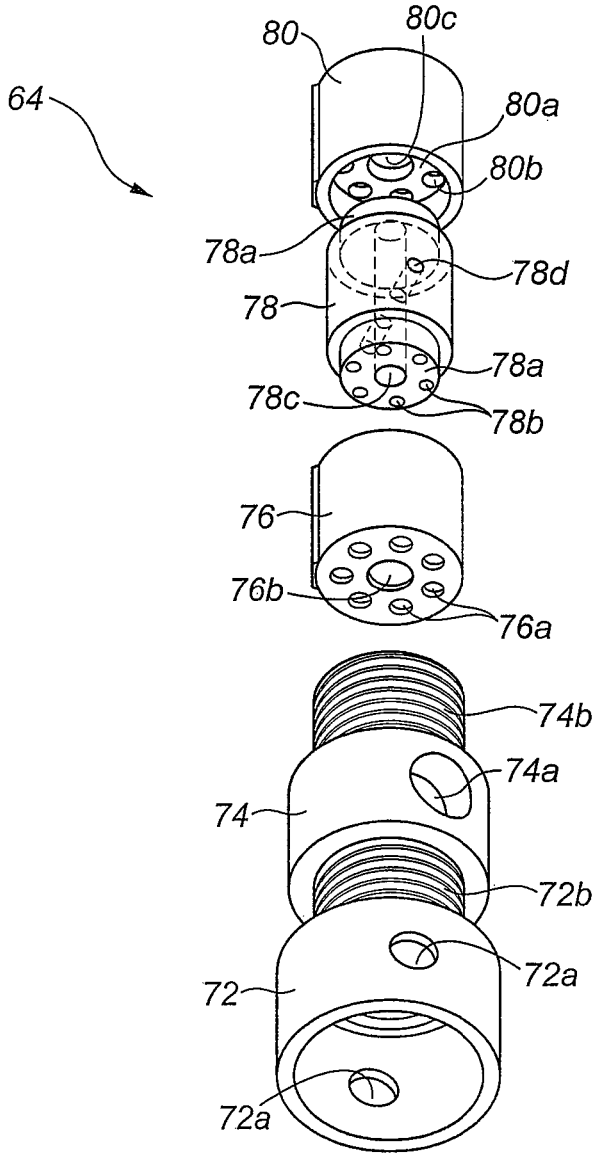
FIG. 8 is a diagrammatic representation of an exploded view of a hydraulic drive of the sonic stimulator of FIG. 6.

Hydraulic couplings for high pressure hydraulic circuits are well known in the art. In one embodiment shown in FIG. 8, the hydraulic coupling (64) is formed of two connectable cylindrical halves, with one half comprising elements (72, 74) and the other half comprising elements (76, 78, 80). Elements (72, 74) are generally cylindrical and have opposed side apertures (72*a*, 74*a*). In one embodiment, apertures (74*a*) have a larger diameter than apertures (72*a*). During manufacture, element (72) is heat-shrunk over element (74) with apertures (72*a*, 74*a*) in axial alignment.

Element (76) is generally cylindrical defining a bore extending therethrough to allow insertion of element (78). Element (76) include a plurality of apertures (76*a*, 76*b*) in a face plate. In one embodiment, a plurality of smaller diameter apertures (76*a*) are arranged on the circumference of the face plate of element (76) to encircle a larger diameter, central aperture (76*b*). Element (78) is generally cylindrical defining a bore extending therethrough and having two opposed end faces (78*a*, the other shown in phantom in FIG. 8). Each face (78*a*) has a plurality of apertures (78*b*, 78*c*). In one embodiment, a plurality of smaller diameter apertures (78*b*) are arranged on the circumference of the face (78*a*) to encircle a larger diameter, central aperture (78*c*). Opposed side apertures (78*d*) (shown in phantom in FIG. 8) are present in the mid-section of element (78). In one embodiment, element (78) is notched at its ends to load into elements (76, 80). Element (80) is generally cylindrical defining a bore extending therethrough to an end face (80*a*). The end face (80*a*) has a plurality of apertures (80*b*, 80*c*). In one embodiment, a plurality of smaller diameter apertures (80*b*) are arranged on the circumference of the end face (80*a*) to encircle a larger diameter, central aperture (80*c*).

In one embodiment, when elements (76, 78, 80) are engaged, the face plate apertures of elements (76) and (78) are offset to avoid alignment. Further, the number of apertures of elements (76, 78) differs. In one embodiment, seven apertures (76*a*) in element (76) feed six apertures (78*b*) in element (78). Elements (76, 78, 80) insert into elements (72, 74) of which threads (72*b*, 74*b*) couple together the two halves to form the hydraulic coupling (64).

During operation, the hydraulic fluid enters the hydraulic coupling (64) through apertures (76*a*, 76*b*). Since apertures of element (78) are offset to apertures of element (76), element (78) rotates as the hydraulic fluid passes through element (78) into element (80). Hydraulic fluid which enters the central aperture (76*b*) passes into the central aperture (78*c*) of rotating element (78). Hydraulic fluid exits from apertures (78*d*) and from element (80) to feed the jet member (60). In one embodiment, the jet member (60) includes a nozzle (72).

Elements (72, 74) serve as a resonance chamber which forms pressure pulses as the hydraulic fluid passes through the coupling. The frequency of the pulses depends upon the number of apertures which transfer the hydraulic fluid from apertures (78*b*) to apertures (78*d*). During each rotation of element (78), a pulse emits as streaming hydraulic fluid hits (i.e., pulses) the resonance chamber formed by elements (72, 74). The wave frequency is determined by the number of pulses per second which can be used to calculate the wavelength being exerted on the production formation. The pressure at which the hydraulic fluid is injected by the hydraulic pump (44) determines the amplitude of the waves and the magnitude of the wave action upon the production formation. The pressure pulses emitted by the hydraulic coupling (64) of the sonic stimulator (56) propagate along the body (58) to create a similar effect (i.e., pulsation) at the jet members (62) at the ends of the sonic stimulator (56). The result is a high cleaning efficiency across greater areas of the wellbore. In one embodiment, the sonic stimulator (56) can stimulate or clean in the range of about 18 to 48 inches in radius, or up to about 8 feet in diameter.

In one embodiment, the sonic stimulator (56) creates pulses with a frequency of about 80 to 250 Hz, with about 30 hp of pulse pressure at the sonic stimulator (56). In one embodiment, the hydraulic coupling (64) requires a pressure range of approximately 5 to 7 MPa back pressure in the sonic stimulator (56) to operate at this rate. In one embodiment, fluid rates range from about 30 to 350 L/min at about 7 to 24 MPa. Preferably, the flow rate is about 100-200 L/min at about 7-14 MPa. It is understood by those skilled in the art that the higher the fluid rate, the higher the pressure, and thus, the greater the pulse pressure (measured in hp) generated at the sonic stimulator (56). Low frequency, high amplitude applications may be designed, which may be achieved with fluid rates less than about 30 L/min, and as low as about 10 L/Min.

Figure 9:
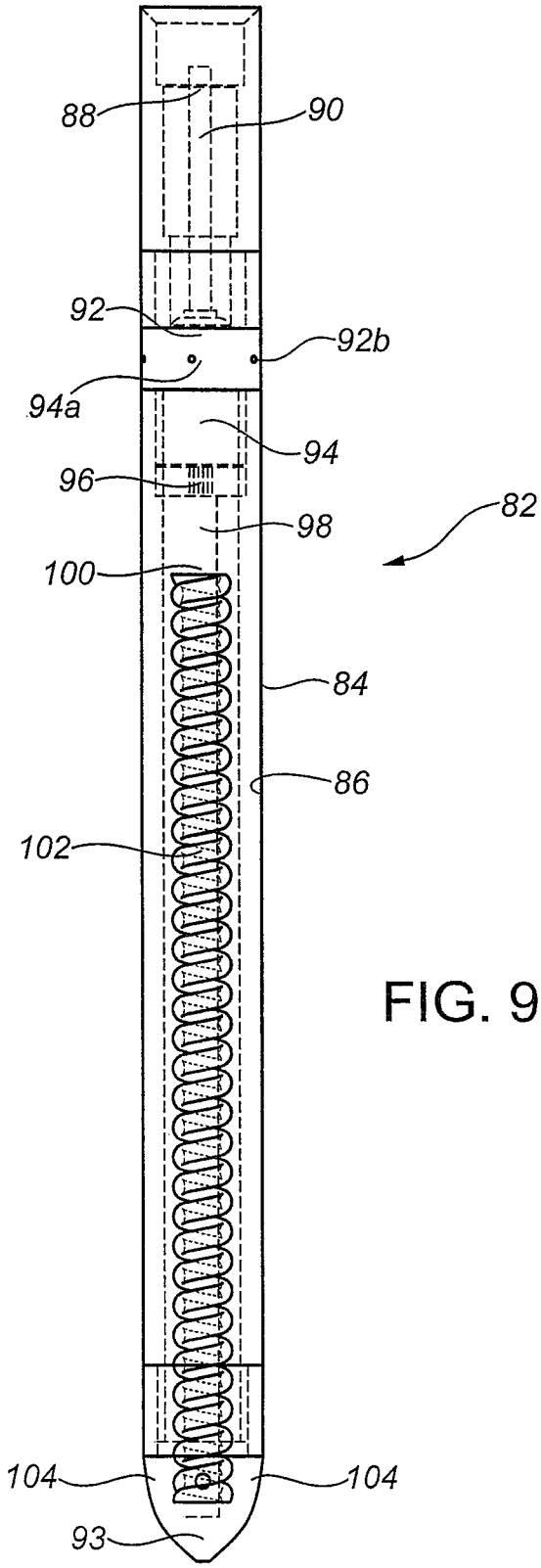
FIG. 9 is a diagrammatic representation of a sonic stimulator of one embodiment of the present invention.
Figure 10:
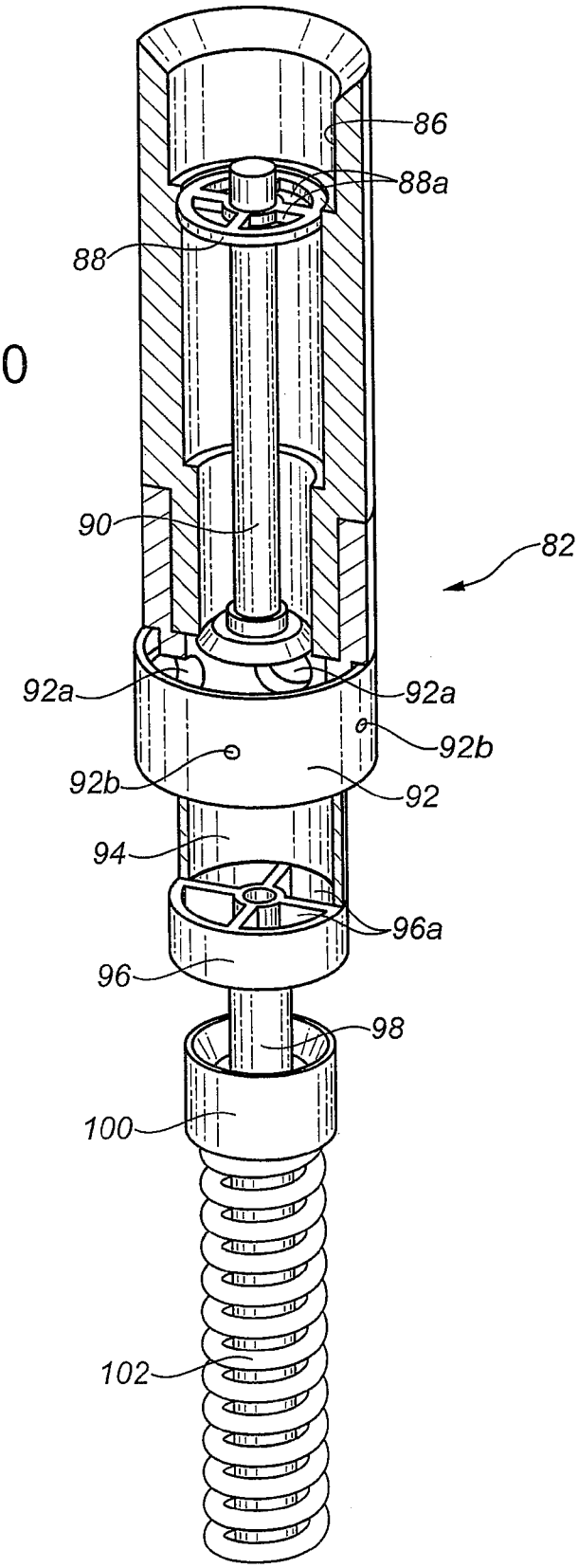
FIG. 10 is a diagrammatic representation of a hydraulic drive unit of the sonic stimulator of FIG. 9.

In one embodiment shown in FIGS. 9 to 10, the sonic stimulator (82) comprises an elongate housing (84) defining a bore (86) extending therethrough to house a valve assembly comprising a valve retainer (88) and a valve (90), a plurality of jet members (92), a resonance section (94), a piston assembly (96, 98, 100) which is moveable between a first position and a second position, and biasing means for biasing the piston (100) towards the first position. The piston (100) fits within reasonably close tolerance to the inside diameter of the housing (84) and divides the sonic stimulator (82) into a proximal section and a distal section. The piston need not fit fluid-tight within the bore, therefore piston rings or seals are not necessary. When fluid is pumped into the proximal section, it passes through the valve assembly, through the resonance assembly and against the piston (100). In one embodiment, the jet members (92) are rotatable on the resonance section (94). In one embodiment, one jet member is an end jet member (93) disposed at the distal end of the sonic stimulator. In one embodiment, the biasing means (102) is a coil spring.

The hydraulic fluid enters the sonic stimulator (82) via the coiled tubing (70) attached to the hydraulic pump (44) at the surface. The fluid passes into the bore (86) of the sonic stimulator (82) through the apertures (88*a*) of the valve retainer (88) to open the valve (90). The valve (90) allows the passage of the hydraulic fluid to the jet members (92). The jet members (92) are ring shaped and are rotatably mounted on the resonance section (94). Resonance apertures (94*a*) in the resonance section (94) are each sized having a diameter larger than that of apertures (92*b*). The fluid passes through large-diameter apertures (94*a*) and exits small-diameter circumferential apertures (92*b*) of the jet members (92), when the apertures are aligned. The circumferential apertures (92*b*) are machined at a tangential angle so that fluid exiting the jet members (92) causes them to rotate. When the apertures (92*b*, 94*a*) of the jet members (92) and resonance assembly (94) align, a resonance chamber forms and a pressure pulse is emitted. The number of apertures of the jet members (92) and the speed at which the jet members (92) rotate determine the frequency of the pressure pulses. The flowrate at which the hydraulic fluid is injected determines the power.

In one embodiment, the hydraulic fluid passes through the apertures (96*a*) of the rod retainer (96) to act on the piston (100) against the biasing means (102). The force of the piston (100) compresses the biasing means (102 and expels fluid from the distal portion through the end jet member (93) and nozzles (104). Once the biasing means (102) is maximally compressed, pressure builds up within the resonance chamber (94), causing closure of the valve (90). The hydraulic fluid continues to exit the jet members (92) until the biasing means (102) overcomes the pressure exerted by the fluid, forcing the fluid backwards. The piston (100) increases the velocity of the hydraulic fluid, which creates a frequency variation by increasing the speed at which the jet members (92) rotate. As the biasing means (102) retracts, it pulls hydraulic fluid from outside the sonic stimulator through the end jet member (93) and nozzles (104). In one embodiment, the end jet member (93) comprises three nozzles (104). The hydraulic fluid is expelled on the next cycle of the piston (100), creating a pulse from the one or more nozzles (104). Pulsation at both ends of the sonic stimulator (82) increases the efficiency of the sonic stimulator (82) on the production formation. Once the biasing means (102) has fully retracted, the pressure of further injected fluid into the sonic stimulator bore (86) opens the valve (90) and the cycle repeats.

The valve (90) may comprise a one-way valve such as a ball valve, or a check valve.

Aspects of the present invention may be combined with alternative enhanced oil recovery techniques. For example, alkali-surfactant (AS) flooding is an established enhanced oil recovery technique used in conventional oil reservoirs. These chemicals carried in the injection brine lower the oil/water interfacial tension mobilizing the flow of some of the trapped oil.

Alkali-surfactant flooding with polymers has been more recently employed to improve EOR flooding of moderately heavy oil. Without polymer flooding or SAGD efforts only 20% or less of the OIP (Oil in Place) may be recovered by primary production techniques due to solution gas drive. With pressure draw down and loss of the gas drive the reservoir energy becomes too depleted for further cold pumping to be economically viable.

It is known that certain types of AS injection, without the addition of polymers, can be used for enhanced non-thermal heavy oil recovery. AS injection, under shear conditions, can reduce the interfacial tension between oil and water to values that allow for oil-in-water or water-in-oil emulsions to form providing enough viscosity and self diversion to sweep additional HOIP (Heavy Oil in Place).

The combination of a sonic stimulator tool (56 or 82) of the present invention and AS flooding may provide efficient recovery of HOIP. The hydraulic power fluid may include additives to perform AS flooding. The sonic stimulator passes the fluid into the formation under shear conditions with uniform propagation, which may stabilize in situ emulsions. Thus, the mobility ratio between water and heavy oil may be reduced and ultimately improve heavy oil sweep efficiencies. These sonic tools can be placed and landed on coiled tubing either in the horizontal section of heavy oil wells or in an injection well strategically placed in a water flood pattern. In a horizontal well installation the tapered injection of AS brine under sonic conditions may generate an energized chemical plume which will sweep 'toe to heel' heavy oil. A tapered injection of AS brine is one where the concentration of additives is varied according to the position of the sonic tool in the wellbore. One skilled in the art will understand the "toe" of a horizontal portion of a well comprises the distal end of the well, away from the vertical section. In an injection well, the same energized chemical plume will sweep emulsified heavy oil outwards to a set of surrounding production wells.

The acoustic waves, which applied at a suitable frequency and amplitude, generated by the sonic stimulators may provide deep uniform penetration of the power fluid, which may have a designed chemistry, and may enhance or generate heavy oil water emulsions for flooding purposes.

The present invention is advantageous over designs of the prior art. The hydraulic actuated pump system (1) lifts production fluids, solids (i.e., sand, shale, clay) and re-circulating hydraulic fluid from the vertical section of a wellbore. The hydraulic fluid and production fluids conveniently drive the system. The hydraulic fluid may comprise water or re-circulated, produced water, thus minimizing cleaning and expense. Further, the hydraulic fluid may be supplemented with additives to apply direct chemical treatment of the production formation, replacing the commonly used drip systems which lack control over chemical placement. Low bottom hole pressure wells may be worked over without requiring nitrogen. Further, the pump system eliminates the requirement for complex, downhole moving parts, and avoids heat issues with thermal floods.

Systems which include moving parts downhole in thermal floods damage quickly and wear out due to high operating temperatures. In the present invention, this is less likely to occur as there are fewer downhole moving parts, temperature does not affect the pump parts, temperature will affect the fluid if it reaches boiling under pressure, but if this occurs it will have even greater velocity to carry fluid from the annulus.

The pump system including a sonic stimulator thus permits injection, cleaning, stimulation and production without requiring well shut down for any of these activities. The pump system may be installed permanently within the well, or modified to be portable, serving as a temporary work over, treating and clean out system.

Where power requirements for the pump system (1) or any component thereof is described, one skilled in the art will realize that any suitable power source may be used, including, without limitation, electrical systems, rechargeable and non-rechargeable batteries, self-contained power units, or other appropriate sources.

In one embodiment, the production of fluids may be enhanced by the use of chemical additives in the power fluid for the jet pump system, or the power fluid to drive the sonic stimulator, or both.

As will be apparent to those skilled in the art, various modifications, adaptations and variations of the foregoing specific disclosure can be made without departing from the scope of the invention claimed herein.

What is claimed is:

1. A method of enhanced oil recovery from a formation, comprising the steps of:

(a) installing a sonic stimulator into a wellbore;

(b) activating the sonic stimulator with a hydraulic power fluid to produce acoustic waves and inject hydraulic power fluid into the formation, wherein the hydraulic power fluid comprises one or more additives to assist in mobilization or emulsification of the oil, and wherein the addition of the additives is tapered so as to place the additives in a specific portion of the wellbore.

2. The method of claim 1, wherein the hydraulic power fluid comprises water, produced water, water-based fluids, water-oil emulsions, inorganic salt solutions, biodegradable plant-based hydraulic fluids, or synthetic and naturally occurring organic materials.

3. The method of claim 1, wherein the hydraulic power fluid comprises water or produced water.

4. The method of claim 1, wherein the one or more additives comprises oils, butanol, esters, silicones, alkylated aromatic hydrocarbons, polyalphaolefins, or corrosion inhibitors.

5. The method of claim 4, wherein the one or more additives comprises a brine-based, heavy oil solution for creating a light oil-in-water emulsion within the production fluids.

6. The method of claim 4, wherein the hydraulic fluid or the supplemented hydraulic fluid is heated to a temperature ranging from about 30° to 101° C.

7. The method of claim 1 wherein the wellbore is a production well, and comprises a vertical portion, and a horizontal portion, and the additives are added so as to place the additives in a toe portion of the horizontal portion.

8. The method of claim 1 wherein the wellbore comprises an injection well, and is proximate one or more production wells.

9. A sonic stimulator for downhole use in a petroleum well, comprising an elongate body having a first end defining an inlet for receiving a hydraulic fluid under pressure and defining a bore extending therethrough, a first tubular jet member at the first end of the body, a second tubular jet member at a second end of the body, and a hydraulic coupling disposed between the first and second ends and comprising a wave generator for generating an acoustic wave as the hydraulic fluid passes through the wave generator, wherein the second tubular jet member exhausts hydraulic fluid from the sonic stimulator from a central nozzle, along a longitudinal axis of the sonic stimulator.

10. The sonic stimulator of claim 9, wherein the first tubular jet member comprises a nozzle, projecting fluid away from the second tubular jet member at an angle to the longitudinal axis of the sonic stimulator.

11. The sonic stimulator of claim 9, wherein the wave generator comprises a cylindrical element which rotates within a resonance chamber.

* * * * *